US007296687B2

(12) United States Patent
Arvidson et al.

(10) Patent No.: US 7,296,687 B2
(45) Date of Patent: Nov. 20, 2007

(54) METHODS OF SEPARATING FEED MATERIALS USING A MAGNETIC ROLL SEPARATOR

(75) Inventors: Bo R. Arvidson, Ponte Vedra Beach, FL (US); Dehua Zhu, Ponte Vedra Beach, FL (US)

(73) Assignee: Outotec Oyj, Espoo (FI)

( * ) Notice: Subject to any disclaimer, the term of this patent is extended or adjusted under 35 U.S.C. 154(b) by 70 days.

(21) Appl. No.: 11/032,293

(22) Filed: Jan. 10, 2005

(65) Prior Publication Data

US 2006/0180504 A1 Aug. 17, 2006

(51) Int. Cl.
*B03C 1/16* (2006.01)

(52) U.S. Cl. ..... 209/637; 209/218

(58) Field of Classification Search ..... 209/213, 209/214, 219, 225, 631, 636, 637, 640, 911, 209/918, 218

See application file for complete search history.

(56) References Cited

U.S. PATENT DOCUMENTS 4,375,853 A * 3/1983 Feller et al. ..... 209/640
5,101,980 A 4/1992 Arvidson
5,271,506 A * 12/1993 Haines ..... 209/640
5,615,775 A 4/1997 Barbaret
5,931,308 A * 8/1999 Gesing et al. ..... 209/212
6,068,133 A * 5/2000 Schonfeld et al. ..... 209/219
6,467,629 B1 * 10/2002 Exner ..... 209/219
6,634,504 B2 * 10/2003 Robinson et al. ..... 209/214
2005/0092656 A1 * 5/2005 Yan et al. ..... 209/12.2

FOREIGN PATENT DOCUMENTS

JP 05277398 A * 10/1993

OTHER PUBLICATIONS

A. AOL Search—Magnetic Roll Separator 2 pages—Oct. 6, 2004.
1. Outokumpu—Inprosys Laboratory Magnetic Roll separator 3 pages—Oct. 26, 2004.
2. Magnetic Separation 14 pages—Source: IEEE on Magnetics, vol.MAG-13 10, No. 2, Jun. 1974—(Last Update: Aug. 2001).

* cited by examiner

*Primary Examiner*—Joseph C. Rodriguez
(74) *Attorney, Agent, or Firm*—Arthur G. Yeager

(57) ABSTRACT

Methods include separating feed material containing magnetic particles and non-magnetic particles using a belt and magnetic roll separator that has an idler roll and a magnetic roll carrying magnets and the methods involve positioning a feed pan or slide for directing the feed onto the belt in contact with the magnetic roll at selectable positions on the belt and at selectable angles of impact onto the belt closely adjacent and contacting the magnetic roll to provide enhanced separation by the forces of feed impact, bounce and gravity and simultaneous magnetic attraction by the magnetic roll.

18 Claims, 20 Drawing Sheets

Silica Sample 1

Table 1: Comparison of RER Performance with Silica Sample 1 Using different feed methods

| Test No. | Feed Rate | Feed Method | Product | Weight (g) | Weight Dist. (%) | $Fe_2O_3$ (%) | Operating conditions (Triple Stages) (Ionizer: Off) |
|---|---|---|---|---|---|---|---|
| Test 1-1 | 0.5t/h.m | Roll | Feed | 294.1 | 100.00 | | Roll Speed=200 rpm |
| | | | Mag | 2.5 | 0.85 | | Splitter position: Inn 5.0 |
| | | | N/Mag | 291.6 | 99.15 | 0.021 | Belt: 0.13mm |
| Test 1-2 | 0.5t/h.m | Belt | Feed | 297.6 | 100.00 | | Roll Speed=200 rpm |
| | | | Mag | 66.5 | 22.31 | | Splitter position: Inn 5.0 |
| | | | N/Mag | 231.2 | 77.69 | 0.028 | Belt: 0.13mm |
| Test 1-3 | 1.0t/h.m | Roll | Feed | 292.9 | 100.00 | | Roll Speed=200 rpm |
| | | | Mag | 1.4 | 0.48 | | Splitter position: Inn 5.0 |
| | | | N/Mag | 291.5 | 99.52 | 0.021 | Belt: 0.13mm |
| Test 1-4 | 1.0t/h.m | Belt | Feed | 292.9 | 100.00 | | Roll Speed=200 rpm |
| | | | Mag | 27.8 | 9.49 | | Splitter position: Inn 5.0 |
| | | | N/Mag | 265.1 | 90.51 | 0.027 | Belt: 0.13mm |
| Test 1-5 | 2.0t/h.m | Roll | Feed | 297.0 | 100.00 | | Roll Speed=200 rpm |
| | | | Mag | 1.7 | 0.57 | | Splitter position: Inn 5.0 |
| | | | N/Mag | 295.3 | 99.43 | 0.025 | Belt: 0.13mm |
| Test 1-6 | 2.0t/h.m | Belt | Feed | 298.9 | 100.00 | | Roll Speed=200 rpm |
| | | | Mag | 14.2 | 4.75 | | Splitter position: Inn 5.0 |
| | | | N/Mag | 284.7 | 95.25 | 0.031 | Belt: 0.13mm |
| Test 1-7 | 3.0t/h.m | Roll | Feed | 298.3 | 100.00 | | Roll Speed=200 rpm |
| | | | Mag | 1.8 | 0.60 | | Splitter position: Inn 5.0 |
| | | | N/Mag | 296.5 | 99.40 | 0.032 | Belt: 0.13mm |
| Test 1-8 | 3.0t/h.m | Belt | Feed | 295.1 | 100.00 | | Roll Speed=200 rpm |
| | | | Mag | 10.6 | 3.59 | | Splitter position: Inn 5.0 |
| | | | N/Mag | 284.5 | 96.41 | 0.033 | Belt: 0.13mm |

FIG. 3

Silica Sample 3

Table 3: Comparison of RER Performance with Silica Sample 3
Using different feed methods

| Test No. | Feed Rate | Feed Method | Product | Weight (g) | Weight Dist. (%) | $Fe_2O_3$ (%) | Operating Conditions (Double Stages) (Ionizer: Off) |
|---|---|---|---|---|---|---|---|
| Test 3-1 | 0.5t/h.m | Roll | Feed | 295.8 | 100.00 | | Roll Speed=200 rpm |
| | | | Mag | 2.4 | 0.81 | | Splitter position: Inn 5.0 |
| | | | N/Mag | 293.4 | 99.19 | 0.020 | Belt: 0.13mm |
| Test 3-2 | 0.5t/h.m | Belt | Feed | 297.7 | 100.00 | | Roll Speed=200 rpm |
| | | | Mag | 48.4 | 16.26 | | Splitter position: Inn 5.0 |
| | | | N/Mag | 249.3 | 83.74 | 0.023 | Belt: 0.13mm |
| Test 3-3 | 1.0t/h.m | Roll | Feed | 294.5 | 100.00 | | Roll Speed=200 rpm |
| | | | Mag | 1.3 | 0.44 | | Splitter position: Inn 5.0 |
| | | | N/Mag | 293.2 | 99.56 | 0.020 | Belt: 0.13mm |
| Test 3-4 | 1.0t/h.m | Belt | Feed | 297.0 | 100.00 | | Roll Speed=200 rpm |
| | | | Mag | 18.7 | 6.30 | | Splitter position: Inn 5.0 |
| | | | N/Mag | 278.3 | 93.70 | 0.031 | Belt: 0.13mm |
| Test 3-5 | 2.0t/h.m | Roll | Feed | 297.7 | 100.00 | | Roll Speed=200 rpm |
| | | | Mag | 1.6 | 0.54 | | Splitter position: Inn 5.0 |
| | | | N/Mag | 296.1 | 99.46 | 0.031 | Belt: 0.13mm |
| Test 3-6 | 2.0t/h.m | Belt | Feed | 299.9 | 100.00 | | Roll Speed=200 rpm |
| | | | Mag | 10.2 | 3.40 | | Splitter position: Inn 5.0 |
| | | | N/Mag | 289.7 | 96.60 | 0.039 | Belt: 0.13mm |
| Test 3-7 | 3.0t/h.m | Roll | Feed | 298.0 | 100.00 | | Roll Speed=200 rpm |
| | | | Mag | 1.7 | 0.57 | | Splitter position: Inn 5.0 |
| | | | N/Mag | 296.3 | 99.43 | 0.034 | Belt: 0.13mm |
| Test 3-8 | 3.0t/h.m | Belt | Feed | 296.36 | 100.00 | | Roll Speed=200 rpm |
| | | | Mag | 8.3 | 2.80 | | Splitter position: Inn 5.0 |
| | | | N/Mag | 288.06 | 97.20 | 0.044 | Belt: 0.13mm |

FIG. 5

Silica Sample 5

Table 5: Comparison of RER Performance with Silica Sample 5 Using different feed methods

| Test No. | Feed Rate | Feed Method | Product | Weight (g) | Weight Dist. (%) | $Fe_2O_3$ (%) | Operating Conditions (Single Stage) (Ionizer Off) |
|---|---|---|---|---|---|---|---|
| Test 5-1 | 0.5t/h.m | Roll | Feed | 298.1 | 100.00 | | Roll Speed=200 rpm |
| | | | Mag | 2.1 | 0.7 | | Splitter position: Inn 5.0 |
| | | | N/Mag | 296.0 | 99.30 | 0.023 | Belt: 0.13mm |
| Test 5-2 | 0.5t/h.m | Belt | Feed | 297.7 | 100.00 | | Roll Speed=200 rpm |
| | | | Mag | 28.1 | 9.44 | | Splitter position: Inn 5.0 |
| | | | N/Mag | 269.6 | 90.56 | 0.026 | Belt: 0.13mm |
| Test 5-3 | 1.0t/h.m | Roll | Feed | 295.3 | 100.00 | | Roll Speed=200 rpm |
| | | | Mag | 1.1 | 0.37 | | Splitter position: Inn 5.0 |
| | | | N/Mag | 294.2 | 99.63 | 0.023 | Belt: 0.13mm |
| Test 5-4 | 1.0t/h.m | Belt | Feed | 298.2 | 100.00 | | Roll Speed=200 rpm |
| | | | Mag | 10.2 | 3.42 | | Splitter position: Inn 5.0 |
| | | | N/Mag | 288.0 | 96.58 | 0.041 | Belt: 0.13mm |
| Test 5-5 | 2.0t/h.m | Roll | Feed | 298.9 | 100.00 | | Roll Speed=200 rpm |
| | | | Mag | 1.4 | 0.34 | | Splitter position: Inn 5.0 |
| | | | N/Mag | 297.5 | 99.66 | 0.042 | Belt: 0.13mm |
| Test 5-6 | 2.0t/h.m | Belt | Feed | 300.4 | 100.00 | | Roll Speed=200 rpm |
| | | | Mag | 5.7 | 1.90 | | Splitter position: Inn 5.0 |
| | | | N/Mag | 294.7 | 98.10 | 0.047 | Belt: 0.13mm |
| Test 5-7 | 3.0t/h.m | Roll | Feed | 298.8 | 100.00 | | Roll Speed=200 rpm |
| | | | Mag | 1.3 | 0.44 | | Splitter position: Inn 5.0 |
| | | | N/Mag | 297.5 | 99.56 | 0.048 | Belt: 0.13mm |
| Test 5-8 | 3.0t/h.m | Belt | Feed | 296.5 | 100.00 | | Roll Speed=200 rpm |
| | | | Mag | 291.5 | 1.69 | | Splitter position: Inn 5.0 |
| | | | N/Mag | 5.0 | 98.31 | 0.051 | Belt: 0.13mm |

FIG. 7

Nepheline Syenite Sample I

Table 7: Comparison of RER performance with Nepheline Syenite Sample Using different feed methods

| Test No. | Sample No. | +40 Micron Content In the sample | Feeding Method | Product | $Fe_2O_3$ (%) |
|---|---|---|---|---|---|
| Test 8-1 | Ch-1 | 80.4% | Belt | N/Mag | 0.24 |
| Test 8-2 | Ch-2 | 76.9% | Belt | N/Mag | 0.24 |
| Test 8-3 | Ch-3 | 70.2% | Belt | N/Mag | 0.24 |
| Test 8-4 | Ch-4 | 72.1% | Belt | N/Mag | 0.21 |
| Test 8-5 | Ch-5 | 66.0% | Belt | N/Mag | 0.20 |
| Test 8-6 | Ch-6 | 38.3% | Belt | N/Mag | 0.17 |
| | | | | | |
| Test 8-7 | Ch-1 | 80.4% | Roll | N/Mag | 0.12 |
| Test 8-8 | Ch-2 | 76.9% | Roll | N/Mag | 0.13 |
| Test 8-9 | Ch-3 | 70.2% | Roll | N/Mag | 0.13 |
| Test 8-10 | Ch-4 | 72.1% | Roll | N/Mag | 0.11 |
| Test 8-11 | Ch-5 | 66.0% | Roll | N/Mag | 0.11 |
| Test 8-12 | Ch-6 | 38.3% | Roll | N/Mag | 0.11 |

operating conditions between Roll Feeding Method and Belt Feeding Method are the same.

FIG. 9

Zircon Sample 1

Table 8 : Comparison of RER performance with Zircon Sample
*Using different feed methods*

| Test No. | Feed Method | Product | Weight Distribution (%) | $ZrO_2$ Grade (%) | $ZrO_2$ Recovery (%) | Operating Conditions (Feed Rate: 2t/h.m) (Belt: 0.13mm) |
|---|---|---|---|---|---|---|
| Test 9-1 | Roll | Feed | 100.00 | 62.45 | 100.00 | Roll Speed=150 rpm |
| | | Mag | 13.40 | 3.63 | 7.92 | Splitter position: 0 |
| | | N/Mag | 86.60 | 66.40 | 92.08 | Ionizer: ON |
| Test 9-2 | Roll | Feed | 100.00 | 62.42 | 100.00 | Roll Speed=160 rpm |
| | | Mag | 12.20 | 34.57 | 6.73 | Splitter position: 0 |
| | | N/Mag | 87.80 | 66.29 | 93.27 | Ionizer: ON |
| Test 9-3 | Roll | Feed | 100.00 | 62.37 | 100.00 | Roll Speed=175 rpm |
| | | Mag | 10.74 | 30.13 | 5.18 | Splitter position: 0 |
| | | N/Mag | 89.30 | 66.22 | 94.82 | Ionizer: ON |
| Test 9-4 | Roll | Feed | 100.00 | 62.26 | 100.00 | Roll Speed=180 rpm |
| | | Mag | 10.60 | 30.13 | 5.08 | Splitter position: 0 |
| | | N/Mag | 89.40 | 66.07 | 94.92 | Ionizer: ON |
| Test 9-5 | Belt | Feed | 100.00 | 60.15 | 100.00 | Roll Speed=150 rpm |
| | | Mag | 18.74 | 33.79 | 10.53 | Splitter position: 0 |
| | | N/Mag | 81.26 | 66.23 | 89.47 | Ionizer: ON |
| Test 9-6 | Belt | Feed | 100.00 | 60.71 | 100.00 | Roll Speed=160 rpm |
| | | Mag | 18.67 | 35.71 | 10.98 | Splitter position: 0 |
| | | N/Mag | 81.33 | 66.45 | 89.02 | Ionizer: ON |
| Test 9-7 | Belt | Feed | 100.00 | 60.61 | 100.00 | Roll Speed=175 rpm |
| | | Mag | 18.35 | 34.99 | 10.59 | Splitter position: 0.0 |
| | | N/Mag | 81.65 | 66.37 | 89.41 | Ionizer: ON |
| Test 9-8 | Belt | Feed | 100.00 | 62.20 | 100.00 | Roll Speed=180 rpm |
| | | Mag | 14.40 | 38.51 | 8.92 | Splitter position: 0 |
| | | N/Mag | 85.60 | 66.18 | 91.08 | Ionizer: ON |

FIG. 11

Silica Sample 2

Table 2: Comparison of RER Performance with Silica Sample 2
Using different feed methods

| Test No. | Feed Rate | Feed Method | Product | Weight (g) | Weight dist. (%) | $Fe_2O_3$ (%) | Operating Conditions (Triple Stages) (Ionizer: On) |
|---|---|---|---|---|---|---|---|
| Test 2-1 | 0.5t/h.m | Roll | Feed | 299.7 | 100.00 | | Roll Speed=200 rpm |
| | | | Mag | 2.5 | 0.83 | | Splitter position: Inn 5.0 |
| | | | N/Mag | 297.2 | 99.17 | 0.021 | Belt: 0.13mm |
| Test 2-2 | 0.5t/h.m | Belt | Feed | 296.3 | 100.00 | | Roll Speed=200 rpm |
| | | | Mag | 63.0 | 21.26 | | Splitter position: Inn 5.0 |
| | | | N/Mag | 233.3 | 78.74 | 0.023 | Belt: 0.13mm |
| Test 2-3 | 1.0t/h.m | Roll | Feed | 295.3 | 100.00 | | Roll Speed=200 rpm |
| | | | Mag | 1.6 | 0.54 | | Splitter position: Inn 5.0 |
| | | | N/Mag | 293.7 | 99.46 | 0.019 | Belt: 0.13mm |
| Test 2-4 | 1.0t/h.m | Belt | Feed | 302.3 | 100.00 | | Roll Speed=200 rpm |
| | | | Mag | 25.5 | 8.44 | | Splitter position: Inn 5.0 |
| | | | N/Mag | 276.8 | 91.56 | 0.023 | Belt: 0.13mm |
| Test 2-5 | 2.0t/h.m | Roll | Feed | 298.1 | 100.00 | | Roll Speed=200 rpm |
| | | | Mag | 1.7 | 0.57 | | Splitter position: Inn 5.0 |
| | | | N/Mag | 296.4 | 99.43 | 0.027 | Belt: 0.13mm |
| Test 2-6 | 2.0t/h.m | Belt | Feed | 297.6 | 100.00 | | Roll Speed=200 rpm |
| | | | Mag | 13.2 | 4.44 | | Splitter position: Inn 5.0 |
| | | | N/Mag | 284.4 | 95.56 | 0.036 | Belt: 0.13mm |
| Test 2-7 | 3.0t/h.m | Roll | Feed | 298.1 | 100.00 | | Roll Speed=200 rpm |
| | | | Mag | 1.8 | 0.6 | | Splitter position: Inn 5.0 |
| | | | N/Mag | 296.3 | 99.40 | 0.037 | Belt: 0.13mm |
| Test 2-8 | 3.0t/h.m | Belt | Feed | 298.8 | 100.00 | | Roll Speed=200 rpm |
| | | | Mag | 11.7 | 3.92 | | Splitter position: Inn 5.0 |
| | | | N/Mag | 287.1 | 96.08 | 0.040 | Belt: 0.13mm |

FIG. 13

Silica Sample 4

Table 4: Comparison of RER Performance with Silica Sample 4 Using different feed methods

| Test No. | Feed Rate | Feed Method | Product | Weight (g) | Weight Dist. (%) | $Fe_2O_3$ (%) | Operating Conditions (Double Stages) (Ionizer: On) |
|---|---|---|---|---|---|---|---|
| Test 4-1 | 0.5t/h.m | Roll | Feed | 300.0 | 100.00 | | Roll Speed=200 rpm |
| | | | Mag | 2.4 | 0.80 | | Splitter position: Inn 5.0 |
| | | | N/Mag | 297.6 | 99.20 | 0.022 | Belt: 0.13mm |
| Test 4-2 | 0.5t/h.m | Belt | Feed | 297.1 | 100.00 | | Roll Speed=200 rpm |
| | | | Mag | 47.1 | 15.85 | | Splitter position: Inn 5.0 |
| | | | N/Mag | 250.0 | 84.15 | 0.023 | Belt: 0.13mm |
| Test 4-3 | 1.0t/h.m | Roll | Feed | 295.6 | 100.00 | | Roll Speed=200 rpm |
| | | | Mag | 1.5 | 0.51 | | Splitter position: Inn 5.0 |
| | | | N/Mag | 294.1 | 99.49 | 0.020 | Belt: 0.13mm |
| Test 4-4 | 1.0t/h.m | Belt | Feed | 301.1 | 100.00 | | Roll Speed=200 rpm |
| | | | Mag | 16.7 | 5.55 | | Splitter position: Inn 5.0 |
| | | | N/Mag | 284.4 | 94.45 | 0.024 | Belt: 0.13mm |
| Test 4-5 | 2.0t/h.m | Roll | Feed | 298.9 | 100.00 | | Roll Speed=200 rpm |
| | | | Mag | 1.6 | 0.54 | | Splitter position: Inn 5.0 |
| | | | N/Mag | 297.3 | 99.46 | 0.030 | Belt: 0.13mm |
| Test 4-6 | 2.0t/h.m | Belt | Feed | 297.6 | 100.00 | | Roll Speed=200 rpm |
| | | | Mag | 9.4 | 3.23 | | Splitter position: Inn 5.0 |
| | | | N/Mag | 288.2 | 96.77 | 0.042 | Belt: 0.13mm |
| Test 4-7 | 3.0t/h.m | Roll | Feed | 298.7 | 100.00 | | Roll Speed=200 rpm |
| | | | Mag | 1.7 | 0.57 | | Splitter position: Inn 5.0 |
| | | | N/Mag | 297.0 | 99.43 | 0.032 | Belt: 0.13mm |
| Test 4-8 | 3.0t/h.m | Belt | Feed | 298.7 | 100.00 | | Roll Speed=200 rpm |
| | | | Mag | 8.2 | 2.75 | | Splitter position: Inn 5.0 |
| | | | N/Mag | 290.5 | 97.25 | 0.045 | Belt: 0.13mm |

FIG 15

Silica Sample 6

Table 6: Comparison of RER Performance with Silica Sample 6
Using different feed methods

| Test No. | Feed Rate | Feed Method | Product | Weight (g) | Weight Dist. (%) | $Fe_2O_3$ (%) | Operating Conditions (Single Stage) (Ionizer: On) |
|---|---|---|---|---|---|---|---|
| Test 6-1 | 0.5t/h.m | Roll | Feed | 299.7 | 100.00 | | Roll Speed=200 rpm |
| | | | Mag | 2.1 | 0.70 | | Splitter position: Inn 5.0 |
| | | | N/Mag | 297.6 | 99.30 | 0.020 | Belt: 0.13mm |
| Test 6-2 | 0.5t/h.m | Belt | Feed | 294.7 | 100.00 | | Roll Speed=200 rpm |
| | | | Mag | 27.6 | 9.37 | | Splitter position: Inn 5.0 |
| | | | N/Mag | 267.1 | 90.63 | 0.026 | Belt: 0.13mm |
| Test 6-3 | 1.0t/h.m | Roll | Feed | 295.9 | 100.00 | | Roll Speed=200 rpm |
| | | | Mag | 1.3 | 0.44 | | Splitter position: Inn 5.0 |
| | | | N/Mag | 294.6 | 99.56 | 0.024 | Belt: 0.13mm |
| Test 6-4 | 1.0t/h.m | Belt | Feed | 302.0 | 100.00 | | Roll Speed=200 rpm |
| | | | Mag | 10.0 | 3.31 | | Splitter position: Inn 5.0 |
| | | | N/Mag | 292.0 | 96.69 | 0.036 | Belt: 0.13mm |
| Test 6-5 | 2.0t/h.m | Roll | Feed | 299.6 | 100.00 | | Roll Speed=200 rpm |
| | | | Mag | 1.4 | 0.47 | | Splitter position: Inn 5.0 |
| | | | N/Mag | 298.2 | 99.53 | 0.041 | Belt: 0.13mm |
| Test 6-6 | 2.0t/h.m | Belt | Feed | 298.2 | 100.00 | | Roll Speed=200 rpm |
| | | | Mag | 5.3 | 1.78 | | Splitter position: Inn 5.0 |
| | | | N/Mag | 292.9 | 98.22 | 0.056 | Belt: 0.13mm |
| Test 6-7 | 3.0t/h.m | Roll | Feed | 299.1 | 100.00 | | Roll Speed=200 rpm |
| | | | Mag | 1.4 | 0.47 | | Splitter position: Inn 5.0 |
| | | | N/Mag | 297.7 | 99.53 | 0.052 | Belt: 0.13mm |
| Test 6-8 | 3.0t/h.m | Belt | Feed | 299.3 | 100.00 | | Roll Speed=200 rpm |
| | | | Mag | 5.0 | 1.67 | | Splitter position: Inn 5.0 |
| | | | N/Mag | 294.3 | 98.33 | 0.056 | Belt: 0.13mm |

FIG. 17

Comparison of RER Performance With Zircon Sample Using Different Feed Methods

| Test No. | Feed Method & Operating Conditions | Name of Product | Wt. Dist. (%) | ZrO2 Grade (%) | ZrO2 Recovery (%) | Sample No. |
|---|---|---|---|---|---|---|
| Test 1 | Feed Method: Standard<br>Model No: LP10-30<br>Feed Rate(MTPH): 2.0<br>Roll Speed(RPM): 160<br>Roll: 3:1<br>Belt: 0.13mm<br>Roll Length: 1meter<br>Ionizer: "ON" | Feed | 100.00 | 62.20 | 100.00 | 28403 |
| | | Mags. | 14.40 | 38.51 | 8.92 | |
| | | N/Mag | 85.60 | 66.18 | 91.08 | 28403-21 |
| Test 2 | Feed Method: 9 Clock<br>Model No: LP10-30<br>Feed Rate(MTPH): 2.0<br>Roll Speed(RPM): 160<br>Roll: 3:1<br>Belt: 0.13mm<br>Roll Length: 1meter<br>Ionizer: "ON" | Feed | 100.00 | 62.45 | 100.00 | 28403 |
| | | Mags. | 13.40 | 36.63 | 7.92 | |
| | | N/Mag | 86.60 | 66.40 | 92.08 | 28403-5 |
| Test 3 | Feed Method: 12 Clock<br>Model No: LP10-30<br>Feed Rate(MTPH): 2.0<br>Roll Speed(RPM): 160<br>Roll: 3:1<br>Belt: 0.13mm<br>Roll Length: 1meter<br>Ionizer: "ON" | Feed | 100.00 | 62.42 | 100.00 | 28403 |
| | | Mags. | 12.20 | 34.57 | 6.73 | |
| | | N/Mag | 87.80 | 66.29 | 93.27 | 28403-9 |
| Test 4 | Feed Method: 10 Clock<br>Model No: LP10-30<br>Feed Rate(MTPH): 2.0<br>Roll Speed(RPM): 160<br>Roll: 3:1<br>Belt: 0.13mm<br>Roll Length: 1meter<br>Ionizer: "ON" | Feed | 100.00 | 62.37 | 100.00 | 28403 |
| | | Mags. | 10.74 | 30.13 | 5.18 | |
| | | N/Mag | 89.30 | 66.22 | 94.82 | 28403-13 |
| Test 5 | Feed Method: 10 Clock<br>Model No: LP10-30<br>Feed Rate(MTPH): 2.0<br>Roll Speed(RPM): 160<br>Roll: 3:1<br>Belt: 0.13mm<br>Roll Length: 1meter<br>Ionizer: "OFF" | Feed | 100.00 | 62.26 | 100.00 | 28403 |
| | | Mags. | 10.60 | 30.13 | 5.08 | |
| | | N/Mag | 89.40 | 66.07 | 94.92 | 28403-17 |

FIG. 19

Comparison of RER Performance With Nepheline Syenite Fine Particles Using Different Feed Methods

| Test No. | +40 Micron Content In the Feed | Name of Product | $Fe_2O_3$ content (%) | |
|---|---|---|---|---|
| | | | Standard Feed Method | Impacting Feed Method |
| Test 1 | 80.4% | N/Mag | 0.24 | 0.12 |
| Test 2 | 76.9% | N/Mag | 0.24 | 0.13 |
| Test 3 | 70.2% | N/Mag | 0.24 | 0.13 |
| Test 4 | 72.1% | N/Mag | 0.21 | 0.11 |
| Test 5 | 66.0% | N/Mag | 0.20 | 0.11 |
| Test 6 | 38.3% | N/Mag | 0.17 | 0.11 |

Note: Other operating conditions between "Standard Feed Method" and "Impacting Feed Method" are the same.

FIG. 21

METHODS OF SEPARATING FEED MATERIALS USING A MAGNETIC ROLL SEPARATOR

CROSS-REFERENCE TO RELATED APPLICATION

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to the use of belted roll magnetic material separation and particularly to an improved method of feeding materials onto such separator.

2. Relevant Art

Magnetic separation technology exploits the difference in magnetic properties between magnetic feed material and non-magnetic material mixed therewith. Magnetic particles are pulled toward a drum shell or belt surface by magnetic force from within the drum or roll. In dry separation processes non-magnetic material is thrown off the apparatus by centrifugal force. The process works reasonably well for relatively coarse particles (for example, >0.55 mm) because the centrifugal force is large enough to provide for adequate separation and when particles are not charged electrostatically to an extent or degree that would interfere with the separation process. What is needed is an improved method for introducing the feed material onto the separation apparatus to enhance separation of the material into magnetic and non-magnetic components, especially for small size or fine particles (for example, <0.55 mm) and for materials that tend to be electrostatically charged.

BRIEF SUMMARY OF THE INVENTION

In one aspect of the present invention there is provided a method of separating feed material including magnetic particles and non-magnetic particles using a magnetic roll separator having an idler roll and a driven magnetic roll carrying magnets about its circumference and a belt in contact with the rolls, comprising the steps of: moving the belt over the rolls; and directing the feed stream onto the belt after contact of the belt with the magnetic roll. Additional steps include: directing the feed stream at an angle perpendicular or nearly perpendicular to the surface of the belt and magnetic roll; directing the feed stream at an acute angle with respect to the surface of the belt and the magnetic roll; selectively directing the feed towards an outer surface of the belt at a plurality of spaced positions; directing the feed with respect to the surface of such belt at a selectable angle; and providing the feed materials with predetermined kinetic energy to cause the non-magnetic particles to bounce away from the belt.

Other aspects of the present invention include kinetically dispensing the magnetic particles to allow the magnetic particles to be attracted and adhere to magnetic poles provided by the magnetic roll; providing the feed materials with predetermined kinetic energy to cause the non-magnetic particles to bounce away from the belt; kinetically dispersing the magnetic particles to allow the magnetic particles to be attracted and to adhere to magnetic poles provided by the magnetic roll; selecting the angle of direction of feed onto the belt to be between an angle perpendicular to the surface of the belt and an acute angle with respect to the surface of the belt.

In an additional aspect of the present invention there is provided a method of separating feed material including magnetic particles and non-magnetic particles using a magnetic roll separator having an idler roll spaced from a magnetic roll carrying magnets about its circumference and a continuous belt in contact with the rolls comprising the steps of: moving the belt over the magnetic roll; directing the feed onto the belt after contact with the magnetic roll at an angle of attack with respect to an outer surface of such belt; and directing the feed stream onto the belt to provide the feed material with sufficient kinetic energy to cause the non-magnetic particles to bounce on impact away form the belt and to disperse the magnetic particles to allow the magnetic particles to be attracted to and adhere to magnetic poles provided by the magnetic roll for enhancing the separation between the magnetic and non-magnetic particles. Other steps include directing the feed stream onto the magnetic roll whereby the angle of the feed stream is substantially perpendicular to the surface of the belt and magnetic roll; directing the feed stream onto the magnetic roll at an acute angle with respect to the surface of the belt and the magnetic roll; or selectively directing the feed stream towards the magnetic roll onto an outer surface of the belt at a plurality of spaced positions; or selectively directing the feed onto the magnetic roll at a plurality of positions where an inner surface of the belt is closely adjacent the magnetic roll; or selecting the angle of feed onto the belt to be between an angle perpendicular to such belt surface and an acute angle with respect to the surface of the belt.

In a further aspect of the present invention there is provided a method for separating feed material including magnetic particles and non-magnetic particles using a belt and magnetic roll separator including a magnetic roll and an idler roll comprising the steps of: moving the belt over the magnetic roll and directing the feed onto the belt closely adjacent and firmly supported by the magnetic roll at a selectable position on the belt and at a selectable angle onto the belt. An additional step includes providing the feed material with sufficient kinetic energy to disperse the magnetic particles to adhere to magnetic poles for enhancing the separation of particles making up the feed material.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

FIGS. 3-21 are illustrations of various samples and test results obtained using the methods of the present invention.

DETAILED DESCRIPTION OF THE INVENTION

Background

A magnetic separator is a device used to separate a mixture of fine, dry materials based upon their magnetic properties. The principles governing this process are magnetism and the interaction between magnetic, gravitational, and centripetal forces. The magnetic characteristics of a material are based upon atomic structure and magnetic field intensity.

The principles involved in the separation apparatus include feed rate, particle velocity and magnetic field strength. Magnetic separation has two general applications:

1. Purification of feeds via the magnetic removal of impurities and (2) the concentration of magnetic materials from a mixture of materials.

Magnetic separation is a process in which two or more materials are separated from each other. The primary force employed is magnetization, however, there are other forces that act upon the particles as well.

Figure 1:
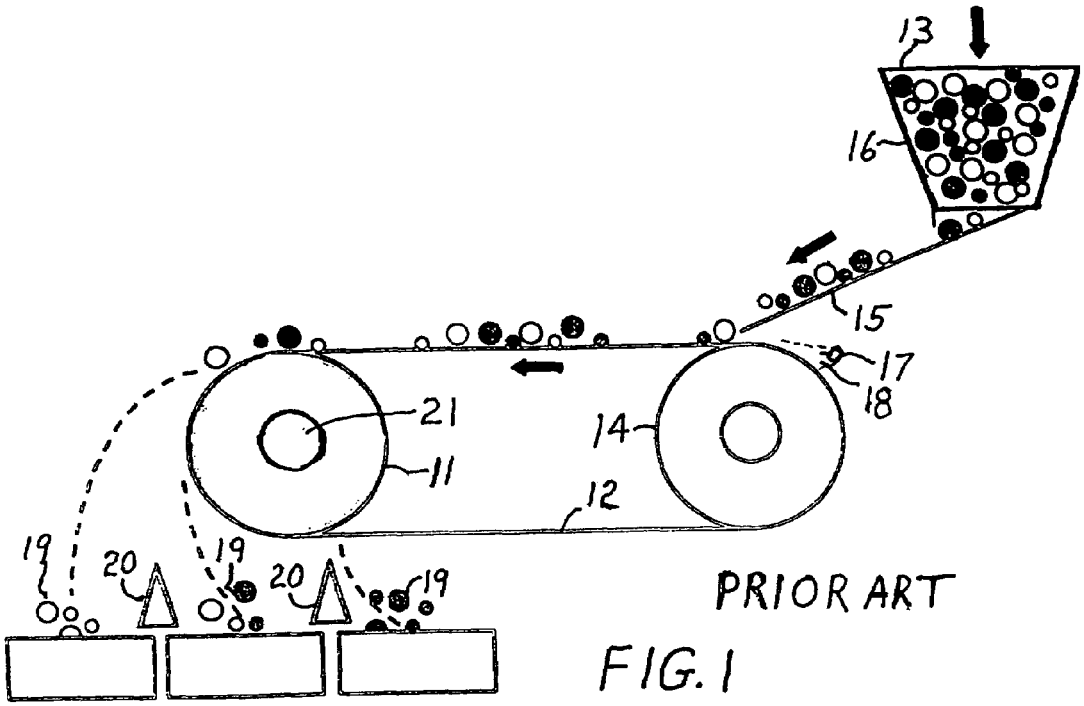
FIG. 1 is a pictorial illustration of a magnetic roll portion of a magnetic separator according to the prior art.

As illustrated in FIG. 1, a separator system 10 employs a magnetic separator roll 11, driven by a mechanism 21 as well known in the art. Belt 12 is also a conventional belt as understood in the art. Feed 13 is directed from feed pan 16 via vibratory feeder 15 onto belt adjacent the idler roll 14. Ionizer 17, when used, provides an ion cloud 18 to neutralize electric charge on belt 12 and assists in removal of particles on the belt. Separated portions 19 are divided by splitters 20 also as understood in the art.

THE PRESENT EMBODIMENT OF AN IMPACTING FEED METHOD

As discussed hereinabove, normally the feed stream is fed onto the belt surface near the idler or non-magnetic roll 14 of the belt separator via feed pan 16. This location is chosen so that the particles have time to "settle down" before they approach the magnetic roll 11.

In the present invention, the feed stream is directed onto the belt at the location where the belt is in contact with the magnetic roll. There are two distinct advantages that derive from this approach. First, the time interval during which particles "settle down" in the prior art can result in the attraction to the belt due to static charges, which causes some of the fine particles to stick to the belt even though they should have been thrown out as non-magnetic product by the centripetal force. Ionizers as discussed hereinabove may assist in the separation, but some interference may still result during the "settling down" time period Second, the use of direct-to-magnetic roll feed allows for directing a given feed at the angle appropriate for optimization of separation for the specific feed properties at hand. In addition, the exact radial location of the feed input to the magnetic roll may be changed to further enhance separation as desired. In the prior art systems, the only input point that is suggested is tangentially onto the belt prior to the belt contacting the magnetic roll 31 prior to the 12 o'clock position. The variability of the "angle of attack" allows for the positioning of the magnetic particles so as to allow them to approach the magnetic surface with some kinetic energy of a predetermined quantity allowing the particles to disperse and to "find" a magnetic pole to adhere to. Finally, the non-magnetic particles will bounce on impact and therefore be thrown out from the roll/belt surface with greater energy thereby enhancing the separation and providing a significant improvement over existing technology.

Figure 2:
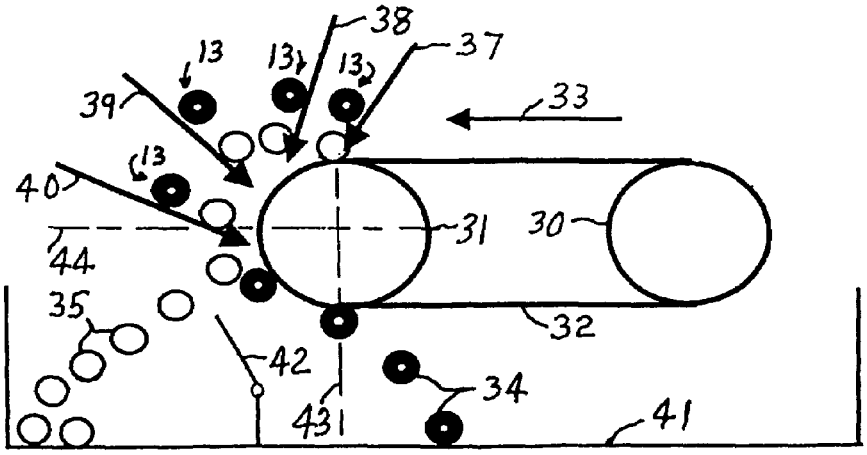
FIG. 2 is a pictorial illustration of a magnetic separator showing various positions and angles of attack (or impact) of the incoming feed flow according to the present invention.

With respect now to FIG. 2, a pictorial illustration of the improved separation method is illustrated. The idler 30, magnetic roll 31 and belt 32 moving in the direction as shown by arrow 33 are substantially as discussed for similar parts in connection with FIG. 1 hereinabove. Magnetic particles 34 are separated from non-magnetic particles 35 and deposited on collection surface 41 employing conventional splitter(s) 42.

Each angle of direction or attack 37, 38, 39 and 40 is chosen based upon the content and type of feed 13 that is to be processed based upon the position of feed pan 13'. Angle of attack 39 is perpendicular to the surface of belt 32 over magnetic roll 31. The other angles 37, 38 and 40 form acute angles with respect to belt 32 surface. The angles of attack 37-40 may be at any position on the outer surface of belt 32 from the vertical axis 43 that extends from an upper 12 o'clock position to the horizontal axis 44 at the 9 o'clock position.

As shown in FIGS. 3-21 a substantial improvement in a separation is obtained for the rare earth magnetic roll separator (RER) system with the impacting feed methods vs. the standard feed methods of the prior art.

The results obtained when the angle of attack is substantially vertically is generally shown as angles 37 and 38 in FIG. 2. These results are set forth in FIGS. 3-12.

Figure 4:
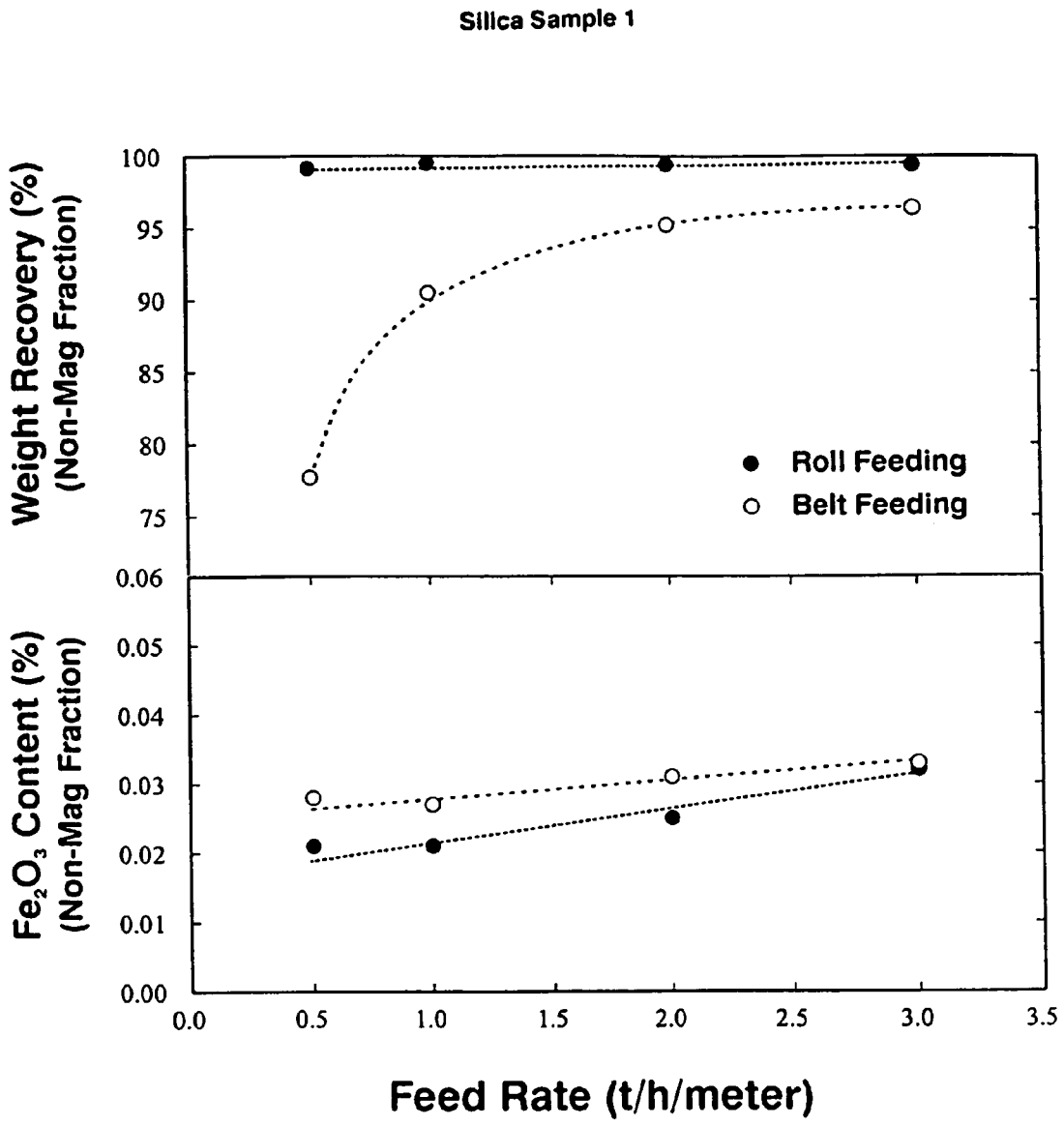
Figure 6:
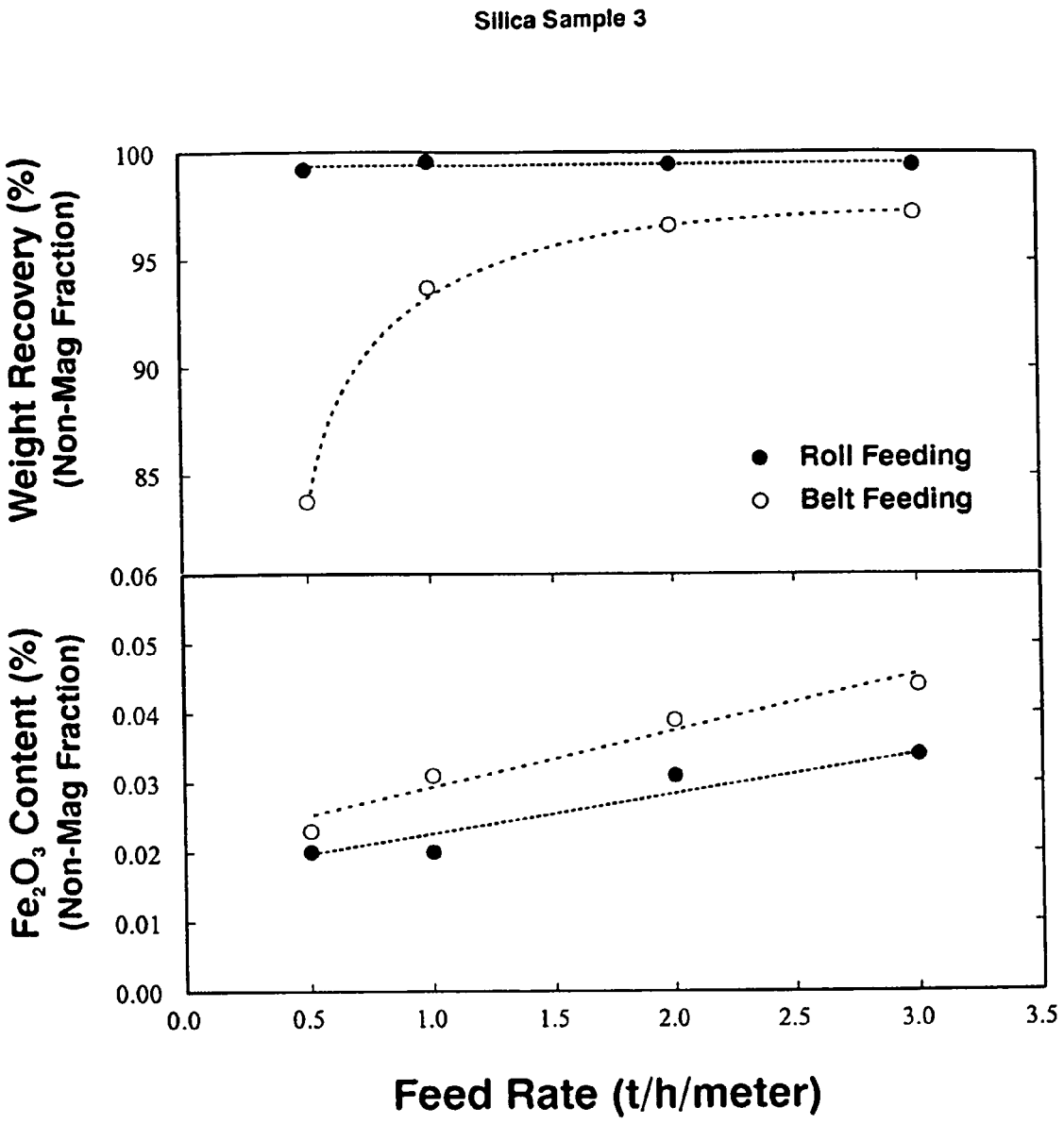
Figure 8:
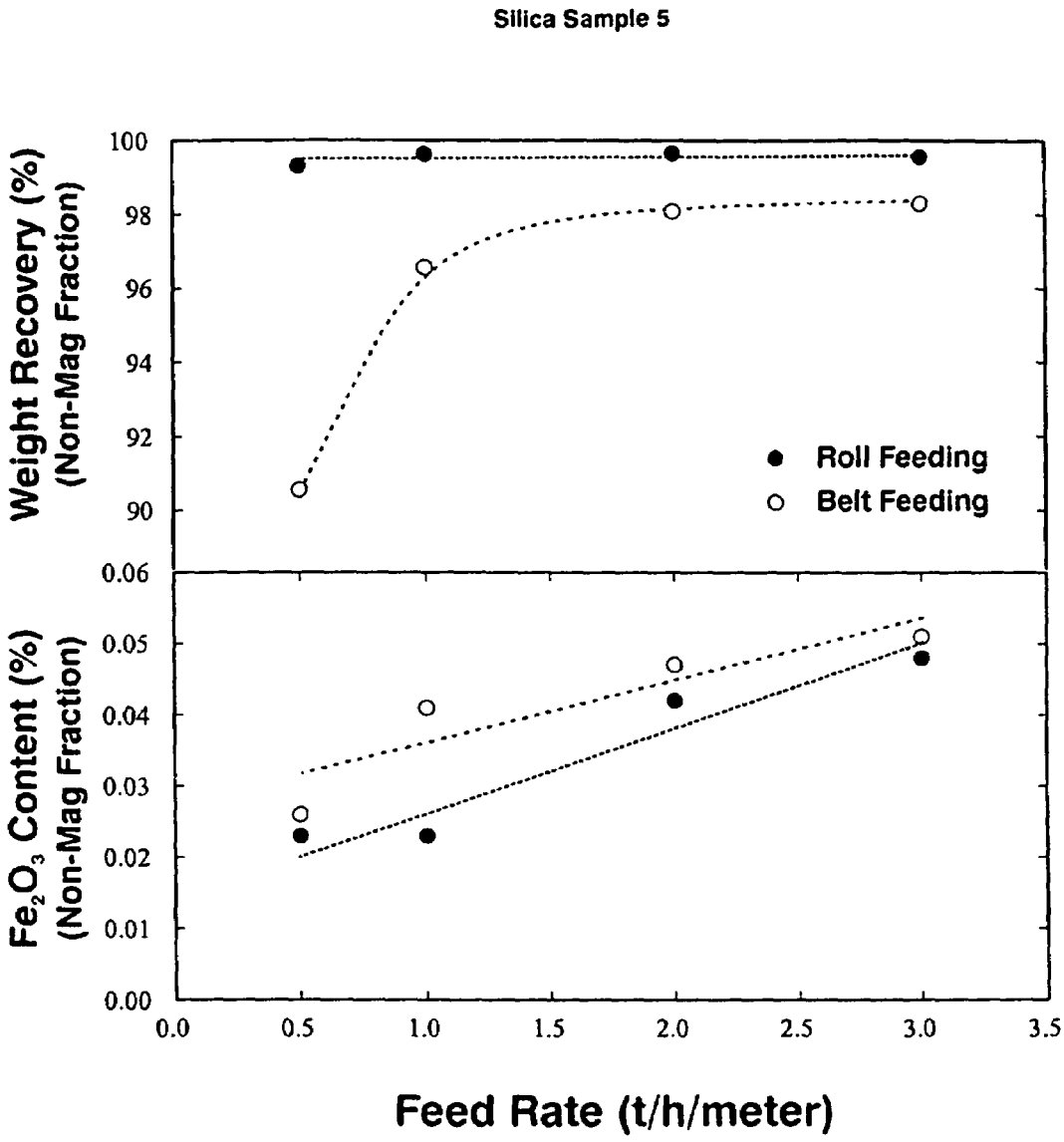

FIG. 3 illustrates the significant improvements that result at four different feed rates in a roll feed method in accord with the present invention vs. a belt feed method of the prior art. The ionizer 17 was off during the test runs. As also shown in FIG. 4, a substantial improvement obtains and does not vary in any significant manner as feed rates increase.

FIGS. 5-8 illustrate results with other samples also with four feed rates. Again, the differences between roll feed and belt feed methods of separation are substantial.

Figure 10:
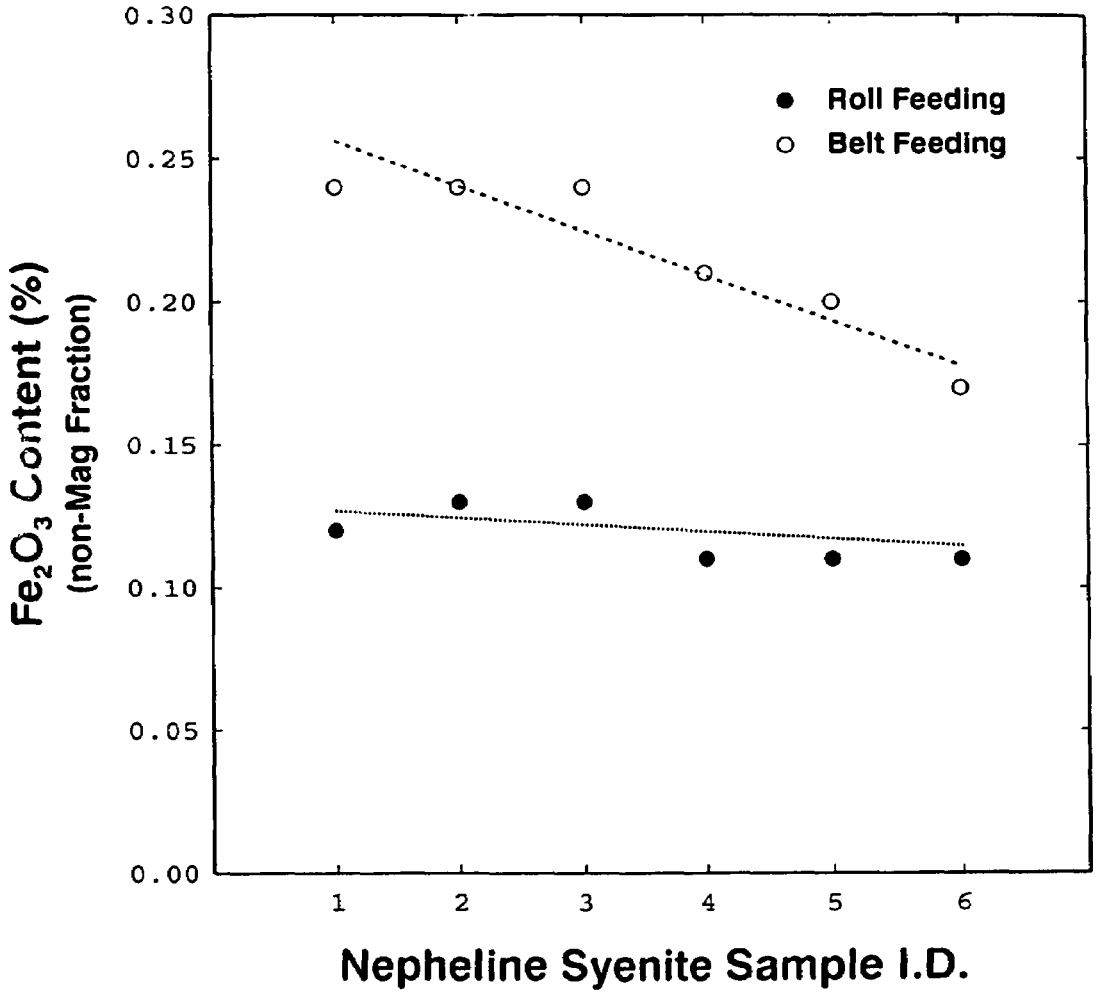

FIGS. 9-10 illustrate six different samples each for belt operation vs. roll operation. A substantial reduction in $Fe_2O_3$ level is obtained from the use of the new impact feed methodology.

Figure 12:
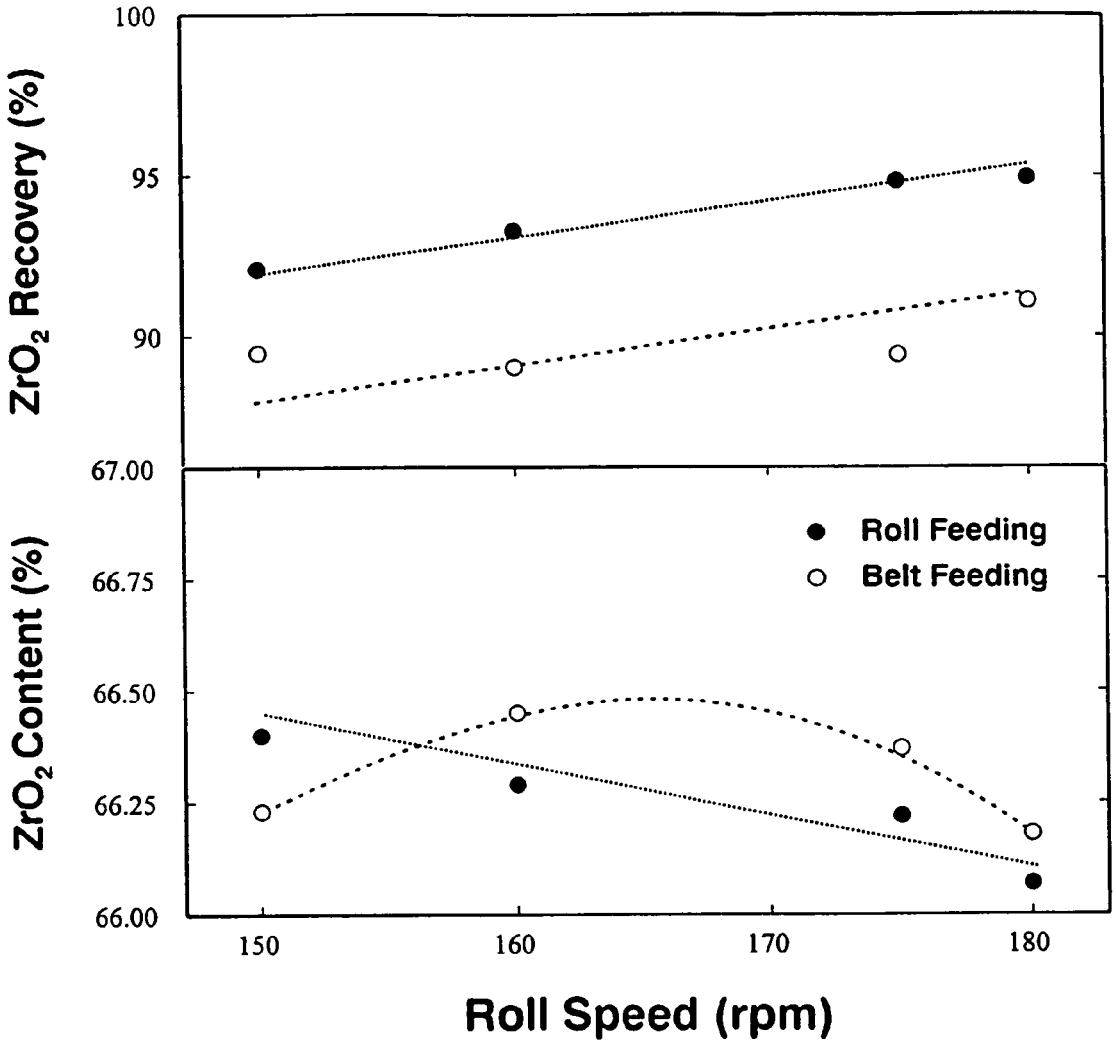

FIGS. 11 and 12 illustrate test runs where ionizer 17 was on and different roll speeds were employed. Here again, the recovery rates of the impact feed methodology were substantially enhanced over the belt approach. In addition, as shown clearly in FIG. 12 the recovery percentage is significantly better employing the methodology of the present invention.

FIGS. 13-18 illustrate results for angles substantially similar to angles 39, 40.

Figure 14:
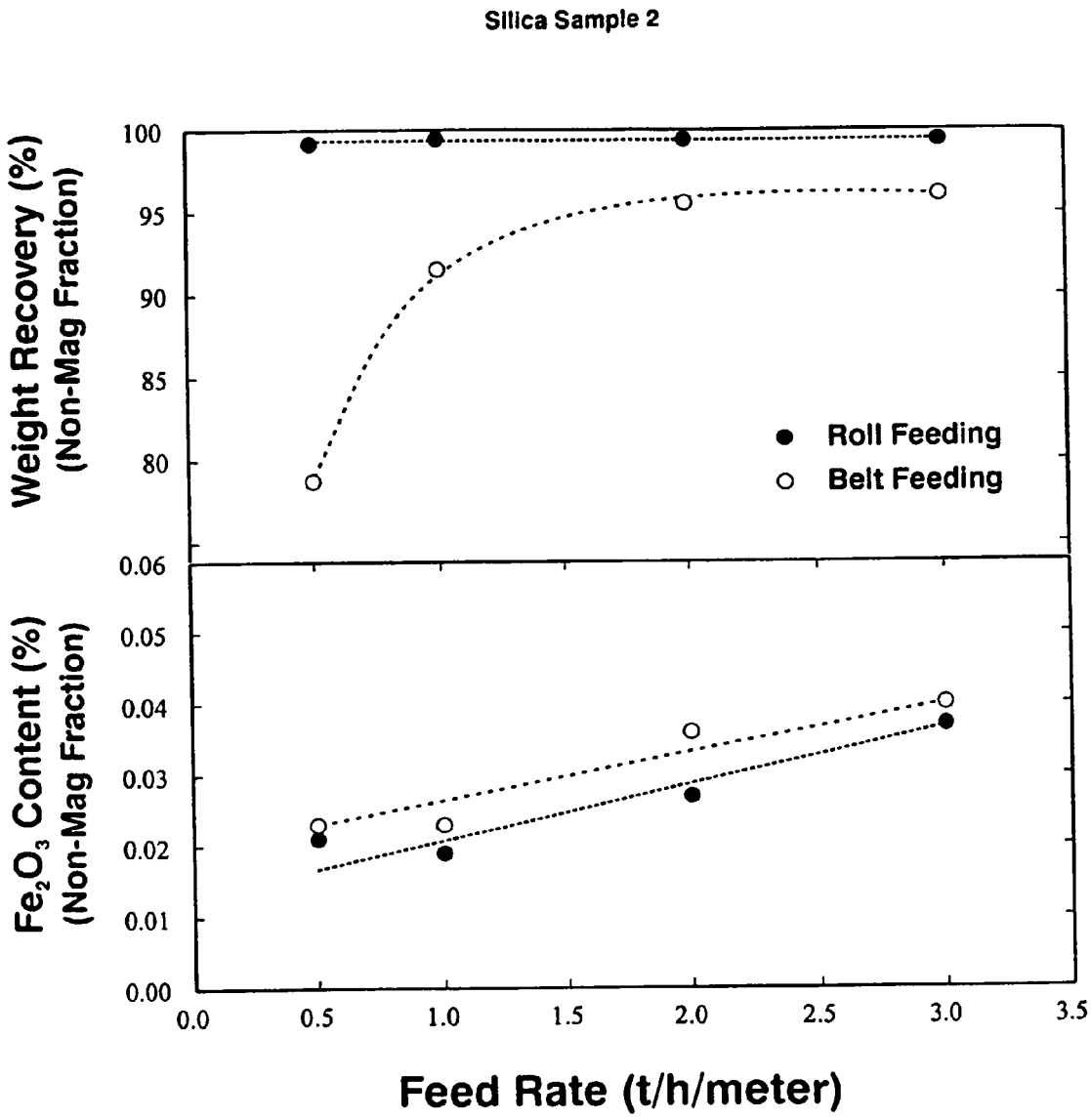

FIGS. 13 and 14 illustrate test results at constant roll speed with ionizer 17 turned on. Recovery is substantially higher with the impact feed methodology and results are more constant in the non-magnetic fraction even with varying feed rates.

Figure 16:
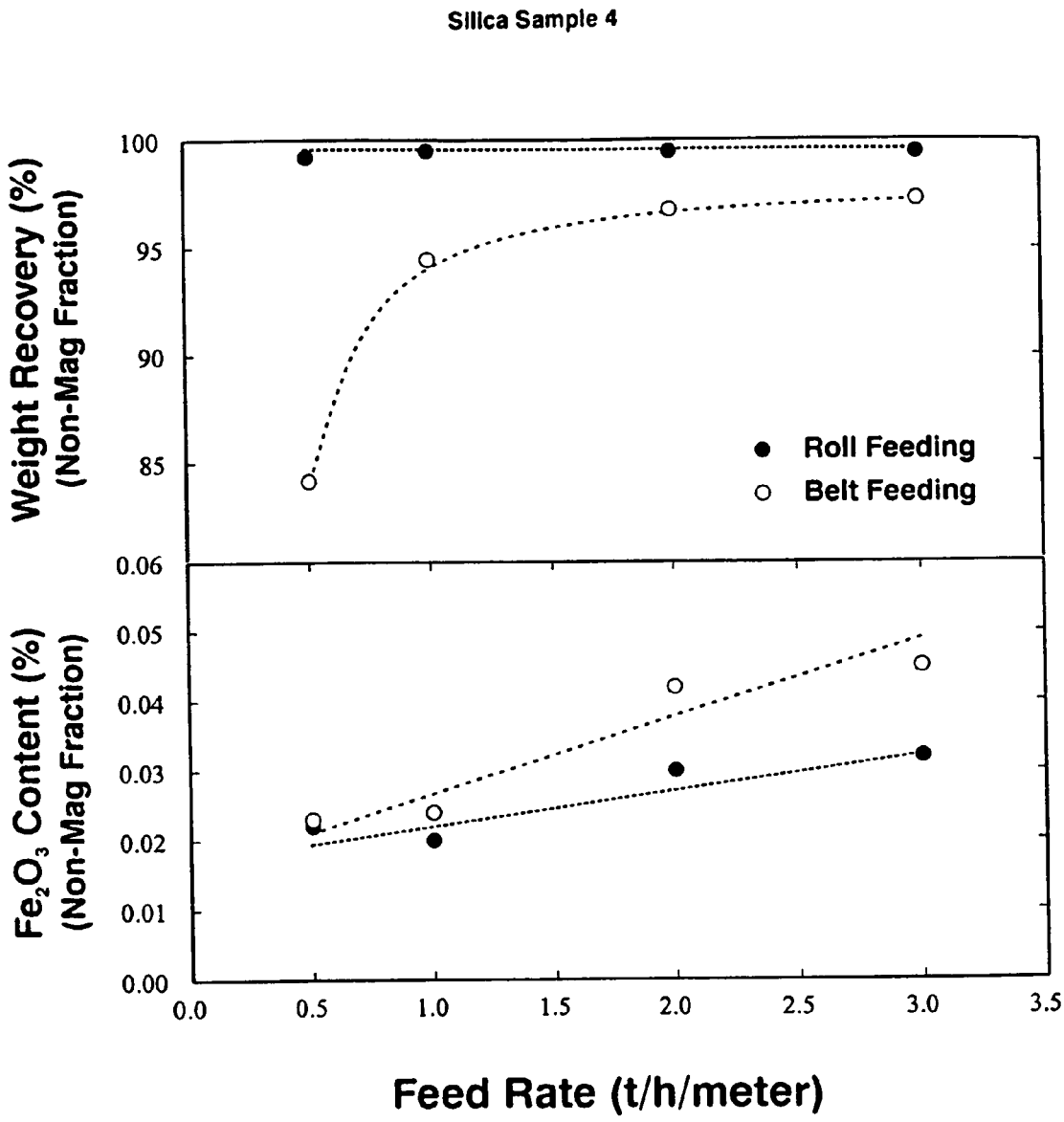

FIGS. 15-16 illustrate results with ionizer 17 on and constant roll speed and show substantially the same improvements as seen hereinabove with respect to FIGS. 13-14.

Figure 18:
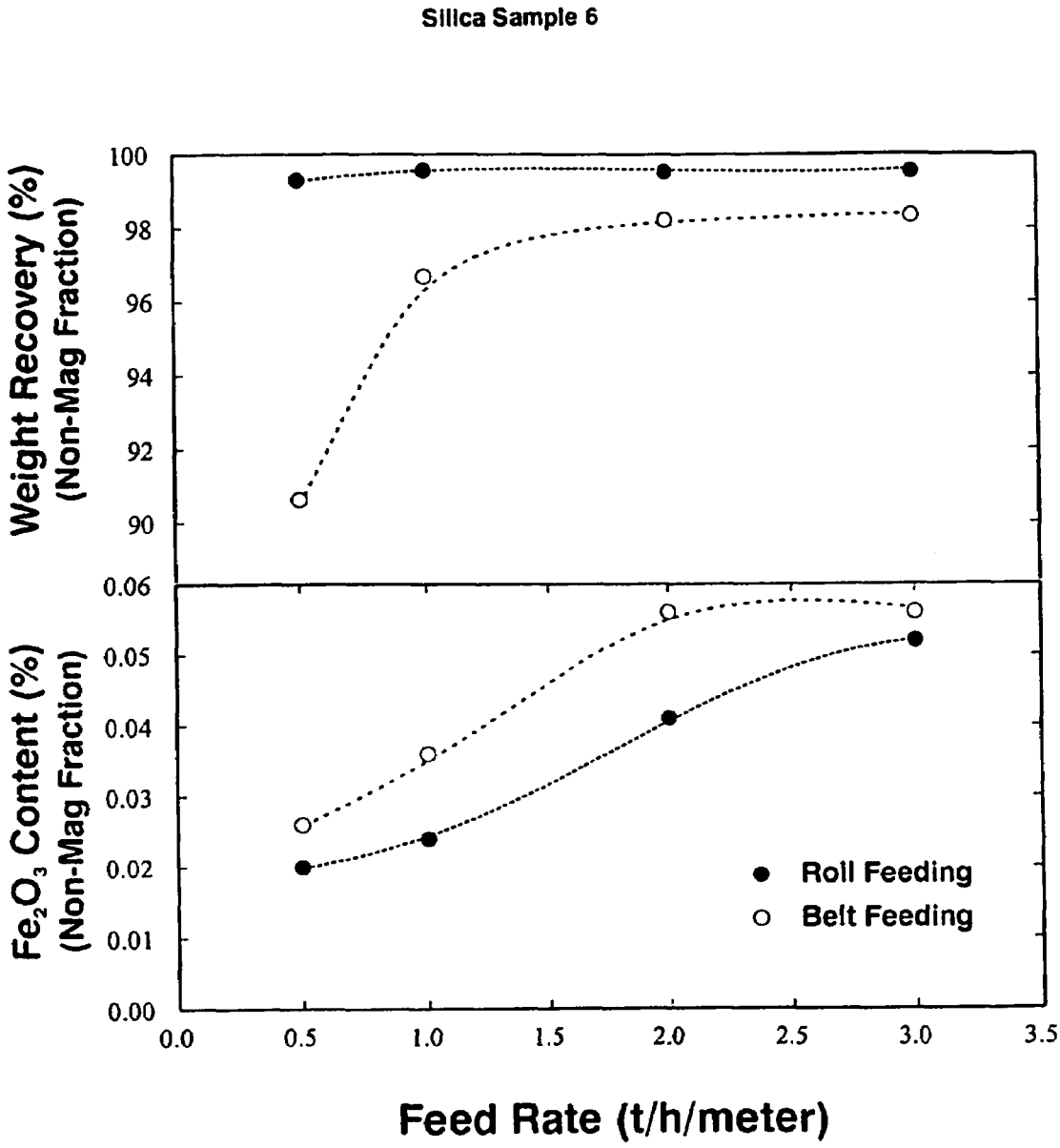

FIGS. 17-18 illustrate other test samples and show similar improvements as seen hereinabove with respect to FIGS. 13-16.

Figure 20:
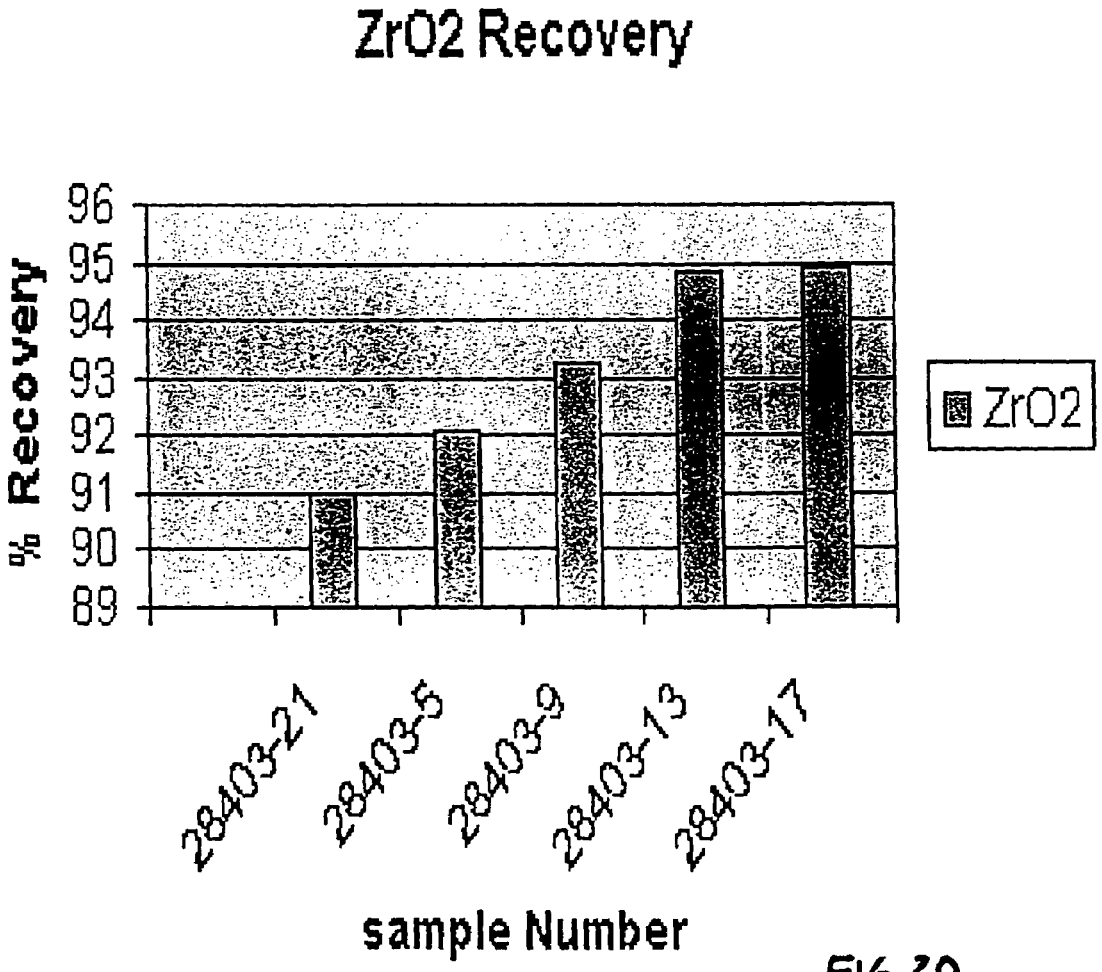

FIGS. 19 and 20 illustrate five test runs employing constant roll speed and feed rates with ionizer 17 on (Nos. 1-4) and off (No. 5) illustrating that the 10 o'clock position of angle of attack offers a substantial improvement, with ionizer on or off, for the particular feed material over the prior art or standard feed position on the belt spacedly removed from the magnetic roll.

FIG. 21 illustrates another set of test runs showing the improved recovery and consistency employing the impact feed methodology according to the present invention.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed is:

1. A method of separating feed material including magnetic particles and non-magnetic particles using a magnetic roll separator having an idler roll and a driven magnetic roll carrying magnets about its circumference and a belt in contact with the rolls, comprising the steps of:

A) moving the belt in contact with and over the magnetic and idler rolls all moving in the same direction;

B) directing the feed material onto the belt after contact of the belt with the magnetic roll; and C) selectively directing the feed towards the surface of the belt at a plurality of spaced positions.

2. The method of claim 1 wherein step B includes the step of:

D) directing the feed into a stream at an angle of the feed stream substantially perpendicular to the surface of the belt and magnetic roll.

3. The method of claim 1 wherein step B includes the step of:

D) directing the feed at an acute angle with respect to the surface of the belt and the magnetic roll.

4. The method of claim 1 wherein step B includes the step of:

D) directing the feed with respect to the surface of such belt at a selectable angle.

5. The method of claim 1 wherein step B includes the steps of:

D) providing the feed materials with predetermined kinetic energy to cause the non-magnetic particles to bounce away from the belt; and E) kinetically dispersing the magnetic particles to allow the magnetic particles to be attracted and to adhere to magnetic poles provided by the magnetic roll.

6. The method of claim 1 wherein step B includes the step of:

D) selecting the angle of direction of feed onto the belt to be between an angle perpendicular to the surface of the belt and an acute angle with respect to the surface of the belt.

7. The method of claim 1 further including the step of:

D) providing an ionizer adjacent an idler roll for neutralizing an electric charge on the belt.

8. A method of separation feed material including magnetic particles and non-magnetic particles using a magnetic roll separator having an idler roll and a driven magnetic roll carrying magnets about its circumference and a belt in contact with the rolls. comprising the steps of:

A) moving the belt in contact with and over the magnetic and idler rolls all moving in the same direction;

B) directing the feed material onto the belt after contact of the belt with the magnetic roll; and C) providing the feed materials in step B with predetermined kinetic energy to cause the non-magnetic particles to bounce away from the belt.

9. The method of claim 8 wherein step B includes the step of:

D) providing the feed material with sufficient kinetic energy to disperse the magnetic particles to allow the magnetic particles to adhere to magnetic poles for enhancing the separation of particles making up the feed material.

10. A method of separating feed material including magnetic particles and non-magnetic particles using a magnetic roll separator having an idler roll and a driven magnetic roll carrying magnets about its circumference and a belt in contact with the rolls, comprising the steps of:

A) moving the belt in contact with and over the magnetic and idler rolls all moving in the same direction;

B) directing the feed material onto the belt after contact of the belt with the magnetic roll; and C) kinetically dispersing the magnetic particles in step B to allow the magnetic particles to be attracted and adhere to magnetic poles provided by the magnetic roll.

11. A method of separating feed material including magnetic particles and non-magnetic particles using a magnetic roll separator having an idler roll spaced from a magnetic roll carrying magnets about its circumference and a continuous belt in contact with the rolls comprising the steps of:

A) moving the belt over the magnetic roll with the belt and roll moving in the same direction;

B) directing the feed onto the belt after contact between the belt and the magnetic roll at an angle of attack with respect to an outer surface of such belt; and C) directing the feed material onto the belt to provide the feed material with sufficient kinetic energy to cause the non-magnetic particles to bounce on impact away from the belt and to disperse the magnetic particles to allow the magnetic particles to be attracted to and adhere to magnetic poles provided by the magnetic roll for enhancing the separation between the magnetic and non-magnetic particles.

12. The method of claim 11 wherein step B includes the step of:

D) directing the feed onto the magnetic roll whereby the angle of the feed is perpendicular to the surface of the belt and magnetic roll.

13. The method of claim 12 wherein step D includes the step of:

D) selecting the angle at which the feed is directed with respect to the surface of the belt.

14. The method of claim 12 wherein step D includes the step of:

D) selecting the angle at which the feed is directed with respect to the surface of the belt.

15. The method of claim 11 wherein step B includes the step of:

D) directing the feed onto the magnetic roll at an acute angle with respect to the surface of the belt and the magnetic roll.

16. The method of claim 15 wherein step D includes the step of:

D) selectively directing the feed onto the belt at a plurality of positions where an inner surface of the belt is in contact with the magnetic roll.

17. The method of claim 11 wherein step B includes the step of:

D) selectively directing the feed towards the magnetic roll onto an outer surface of the belt at a plurality of spaced positions.

18. The method of claim 11 wherein step B includes the step of:

D) selecting the angle of feed onto the belt to be between an angle perpendicular to such belt surface and an acute angle with respect to the surface of the belt.

* * * * *